US006867356B2

(12) United States Patent
Nishimoto

(10) Patent No.: US 6,867,356 B2
(45) Date of Patent: Mar. 15, 2005

(54) MUSICAL TONE GENERATING APPARATUS, MUSICAL TONE GENERATING METHOD, AND PROGRAM FOR IMPLEMENTING THE METHOD

(75) Inventor: Tetsuo Nishimoto, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 207 days.

(21) Appl. No.: 10/364,036

(22) Filed: Feb. 11, 2003

(65) Prior Publication Data

US 2003/0150319 A1 Aug. 14, 2003

(30) Foreign Application Priority Data

Feb. 13, 2002 (JP) ..... 2002-035405

(51) Int. Cl.[7] ..... G10H 7/00
(52) U.S. Cl. ..... 84/603
(58) Field of Search ..... 84/603–605, 633

(56) References Cited

U.S. PATENT DOCUMENTS 5,567,901 A * 10/1996 Gibson et al. ..... 84/603
5,691,496 A * 11/1997 Suzuki et al. ..... 84/661
5,754,666 A 5/1998 Nakagawa
5,850,049 A * 12/1998 Kamiya ..... 84/607
5,872,727 A * 2/1999 Kuo ..... 708/313
5,969,282 A * 10/1999 Berners et al. ..... 84/603

FOREIGN PATENT DOCUMENTS

JP 63-219631 9/1988

* cited by examiner

*Primary Examiner*—Jeffrey W Donels
(74) *Attorney, Agent, or Firm*—Pillsbury Winthrop LLP

(57) ABSTRACT

There is provided a musical tone generating apparatus that is capable of generating more natural musical tones even when musical tone waveform data is generated at a recording sampling frequency lower than a sampling frequency, by recovering harmonic components missing in the musical tone waveform data. All frequency components included in musical tone waveform data read out from a tone color data memory are shifted in a positive direction by a predetermined frequency lower than half the recording sampling frequency. The lower frequency components of the shifted frequency components than the half the recording sampling frequency are cut off by an HPF. The amplitude of the musical tone waveform data from which the frequency component is cut off is adjusted by a multiplier. Then, the musical tone waveform data adjusted in amplitude and the original musical tone waveform data read out are added together, and a musical tone is generated based on a result of the addition.

8 Claims, 7 Drawing Sheets

MUSICAL TONE GENERATING APPARATUS, MUSICAL TONE GENERATING METHOD, AND PROGRAM FOR IMPLEMENTING THE METHOD

BACKGROUND OF THE INVENTION

1. Field of the Invention

The present invention relates to musical tone generating apparatus and method that read out musical tone waveform data sampled and stored in a waveform memory and generate musical tones based on the musical tone waveform data, and a program for implementing the method.

2. Description of the Related Art

Conventionally, a so-called waveform table (wave table) tone generator is known which stores waveform data prepared by sampling tones of a musical instrument in a waveform memory, and generates musical tones by reading out the waveform data from the waveform memory.

In the above conventional waveform table tone generator, to reduce the storage capacity of the waveform memory, musical tones are sometimes sampled at a lower frequency than the original sampling frequency of the tone generator system, specifically, a frequency at which musical tones are generated by reading out musical tone waveform data from the waveform memory. Hereinafter, the original sampling frequency of the tone generator system will be referred to as "the sampling frequency", and the frequency at which musical tones are sampled to generate musical tone waveform data will be referred to as "the recording sampling frequency". It should be noted that the term "recording sampling frequency" is intended to mean not only the sampling frequency at which musical tones are directly recorded or sampled but also a sampling frequency at which the musical tones once sampled are re-sampled (down-sampled).

The recording sampling frequency corresponds to the number of musical tone waveform samples (waveform samples forming musical tone waveform data) per unit time (one second), and hence, as the recording sampling frequency is lowered, the volume of the stored musical tone waveform data is reduced. This reduces the capacity of the waveform memory necessary for the storage of the musical tone waveform data.

However, according to the sampling theorem, the recording sampling frequency determines the upper limit frequency (=half the recording sampling frequency) of reproducible musical tones (assuming that the recording sampling frequency is 16 KHz, musical tones whose frequency range is up to 8 KHz can be reproduced). In other words, when the recording sampling frequency is held low, musical tones missing high-order harmonic components thereof are reproduced, which results in degraded quality of the reproduced musical tones.

SUMMARY OF THE INVENTION

It is an object of the present invention to provide musical tone generating apparatus and method that is capable of generating more natural musical tones even when musical tone waveform data is generated at a recording sampling frequency lower than a sampling frequency, by recovering harmonic components missing in the musical tone waveform data, and a program for implementing the musical tone generating method, and a storage memory.

To attain the above object, in a first aspect of the present invention, there is provided a musical tone generating apparatus comprising a waveform memory that stores musical tone waveform data obtained by sampling a tone of a musical instrument at a recording sampling frequency lower than an original sampling frequency of the musical tone generating apparatus, and a musical tone generator that generates a musical tone based on the musical tone waveform data read out, and the musical tone generator comprises a shifter that shifts all frequency components included in the musical tone waveform data read out in a positive direction by a predetermined frequency lower than half the recording sampling frequency, an amplitude adjuster that adjusts amplitude of musical tone waveform data formed by the shifter by shifting the frequency components, and an adder that adds together the musical tone waveform data adjusted in amplitude and the musical tone waveform data read out.

According to the first aspect of the present invention, all the frequency components included in the musical tone waveform data read out from the waveform memory are shifted in the positive or increasing direction by the predetermined frequency lower than the half of the recording sampling frequency. The lower frequency component of the shifted frequency components than the half the recording sampling frequency are cut. The amplitude of the musical tone waveform data from which the frequency components are cut off is adjusted. Then the musical tone waveform data adjusted in amplitude is added to the musical tone waveform data read out. In short, frequency components of the musical instrument tone higher in frequency than half of the sampling frequency, which were lost when the tone of the musical instrument was sampled at the recording sampling frequency, are approximately recovered based on the sampled or preserved frequency components lower in frequency than the half the sampling frequency. This makes it possible to generate a more natural musical tone.

Preferably, the shifter comprises a generator that generates a sinusoidal wave signal of a predetermined frequency lower than the half the recording sampling frequency, a multiplier that multiplies the musical tone waveform data read out by the generated sinusoidal wave signal, and a cutter that cuts off frequency components of the resulting product of the multiplication lower in frequency than the half the recording sampling frequency.

Preferably, the tone of the musical instrument for sampling has a non-linear frequency spectrum.

Preferably, the predetermined frequency is determined depending on the musical instrument of which the tone is sampled.

Preferably, the musical tone generating apparatus further comprises a selector that selects between generation of a musical tone based on musical tone waveform data formed by adding together the musical tone waveform data adjusted in amplitude and the musical tone waveform data read out, and generation of a musical tone based on the musical tone waveform data read out to which the musical tone waveform data adjusted in amplitude is not added.

More preferably, the selector is operable when the musical tone has a non-linear frequency spectrum, to select the generation of a musical tone based on the musical tone waveform data formed by adding together the musical tone waveform data adjusted in amplitude and the musical tone waveform data read out.

To attain the above object, in a second aspect of the invention, there is provided a musical tone generating method comprising a reading step of reading out musical tone waveform data from a waveform memory storing the musical tone waveform data obtained by sampling a tone of a musical instrument at a recording sampling frequency lower than a sampling frequency at which a musical tone is generated, and a musical tone generating step of generating the musical tone based on the musical tone waveform data read out, and the musical tone generating step comprises the steps of shifting all frequency components included in the musical tone waveform data read out, in a positive direction by a predetermined frequency lower than half the recording sampling frequency, adjusting amplitude of musical tone waveform data formed by shifting the frequency components, adding together the musical tone waveform data adjusted in amplitude and the musical tone waveform data read out, and generating the musical tone based on a result of the addition.

To attain the above object, in a third aspect of the invention, there is provided a program for causing a computer to execute the musical tone generating method described above.

According to the third aspect of the present invention, the same advantageous effects as obtained by the first aspect of the present invention can be obtained.

The above and other objects, features, and advantages of the invention will become apparent from the following detailed description taken in conjunction with the accompanying drawings.

BRIEF DESCRIPTION OF THE DRAWINGS

FIGS. 6A to 6D are showing results of signal processing executed by predetermined sections of the waveform table tone generator in FIG. 5, in which:

FIG. 6A shows a frequency spectrum of musical tone waveform data generated by sampling a musical tone at a recording sampling frequency of 16 KHz;

FIG. 6B shows a frequency spectrum of musical tone waveform data which a multiplier 27 appearing in FIG. 5 produces by multiplying the FIG. 6A musical tone waveform data by digital data representative of a sine wave of 8 KHz;

FIG. 6C shows a frequency spectrum of musical tone waveform data which is produced by an HPF 29 appearing in FIG. 5 by eliminating frequency components (frequency spectrum) below 8 KHz from the FIG. 6B waveform data; and FIG. 6D shows a frequency spectrum of musical tone waveform data as a result of addition by an adder 31 appearing in FIG. 5, i.e. a frequency spectrum of a desired musical tone signal.

DETAILED DESCRIPTION OF THE PREFERRED EMBODIMENTS

The present invention will now be described in detail with reference to the drawings showing an embodiment thereof.

Figure 1:
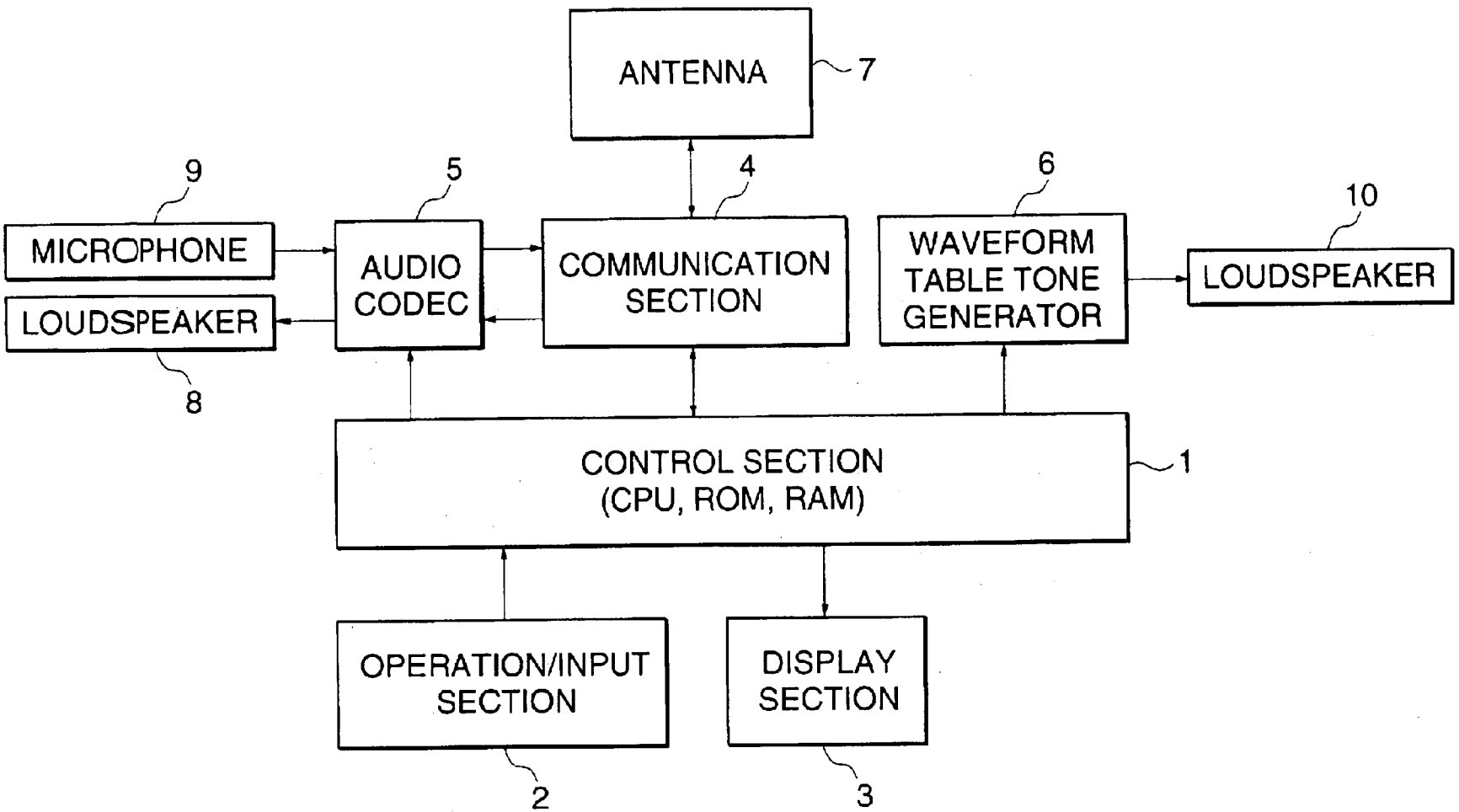
FIG. 1 is a block diagram schematically showing the whole arrangement of a cellular phone to which is applied a musical tone generating apparatus according to an embodiment of the present invention.

Referring first to FIG. 1, there is schematically shown the whole arrangement of a cellular phone to which is applied a musical tone generating apparatus according to an embodiment of the present invention.

As shown in the figure, a control section 1 is comprised of a CPU that controls the overall operation of the cellular phone, a ROM that stores control programs executed by the CPU, various table data, etc., and a RAM that temporarily stores performance data (e.g. in MIDI (Musical Instrument Digital Interface) format) for playing an incoming call melody or the like, various kinds of input information, operation results, and so forth.

Connected to the control section 1 are an operation/input section 2 including a ten-key keypad and operating elements for inputting various pieces of information, a display section 3 including e.g. a color liquid crystal display (LCD) and light-emitting diodes (LED), an audio CODEC 5 that converts an analog audio signal to a digital signal and then compresses the digital audio signal, and inversely expands a compressed digital audio signal and then converts the expanded digital audio signal to an analog audio signal, a communication section 4 that modulates a signal output from the audio CODEC 5 and then transmits the modulated signal to a relay station, not shown, via an antenna 7, and receives via the antenna 7 a signal transmitted from the relay station and decodes the signal to output the decoded signal to the audio CODEC 5, and a waveform table tone generator 6 including a tone color data memory (waveform memory), referred to hereinafter, the tone generator 6 reading out desired musical tone waveform data from the tone color data memory, executing various processes on the read musical tone waveform data to form a digital musical tone signal, and then converting the formed digital musical tone signal to an analog signal by a DAC (Digital-to-Analog Converter), followed by outputting the analog musical tone signal.

Connected to the audio CODEC 5 are a loudspeaker 8 for converting an analog audio signal output from the audio CODEC 5 to sound and a microphone 9 for converting sound to an analog audio signal.

Connected to the waveform table tone generator 6 is a loudspeaker 10 for converting an analog musical tone signal output from the waveform table tone generator 6 to sound.

The essential feature of the present invention consists in the waveform table tone generator 6, especially in a musical tone-generating process executed by the waveform table tone generator 6. As a precondition for executing the musical tone-generating process, it is necessary to sample musical tones at a recording sampling frequency lower than a sampling frequency to form musical tone waveform data, and register the musical tone waveform data in the tone color data memory. It should be noted that in the present embodiment, the "sampling frequency" is intended to mean the original sampling frequency of the waveform table tone generator 6, whereas the "recording sampling frequency" is interned to mean a sampling frequency at which musical tones are sampled to generate musical tone waveform data, as described hereinbefore. Further, the term "recording sampling frequency" includes not only the sampling frequency at which musical tones are directly recorded or sampled but also a sampling frequency at which the musical tones once sampled are re-sampled (down-sampled). In the following, a description will be given of a sequence of operations from sampling of musical tones to registration of musical tone waveform data in the tone color data memory, i.e. a tone color data memory-preparing process.

Figure 2:
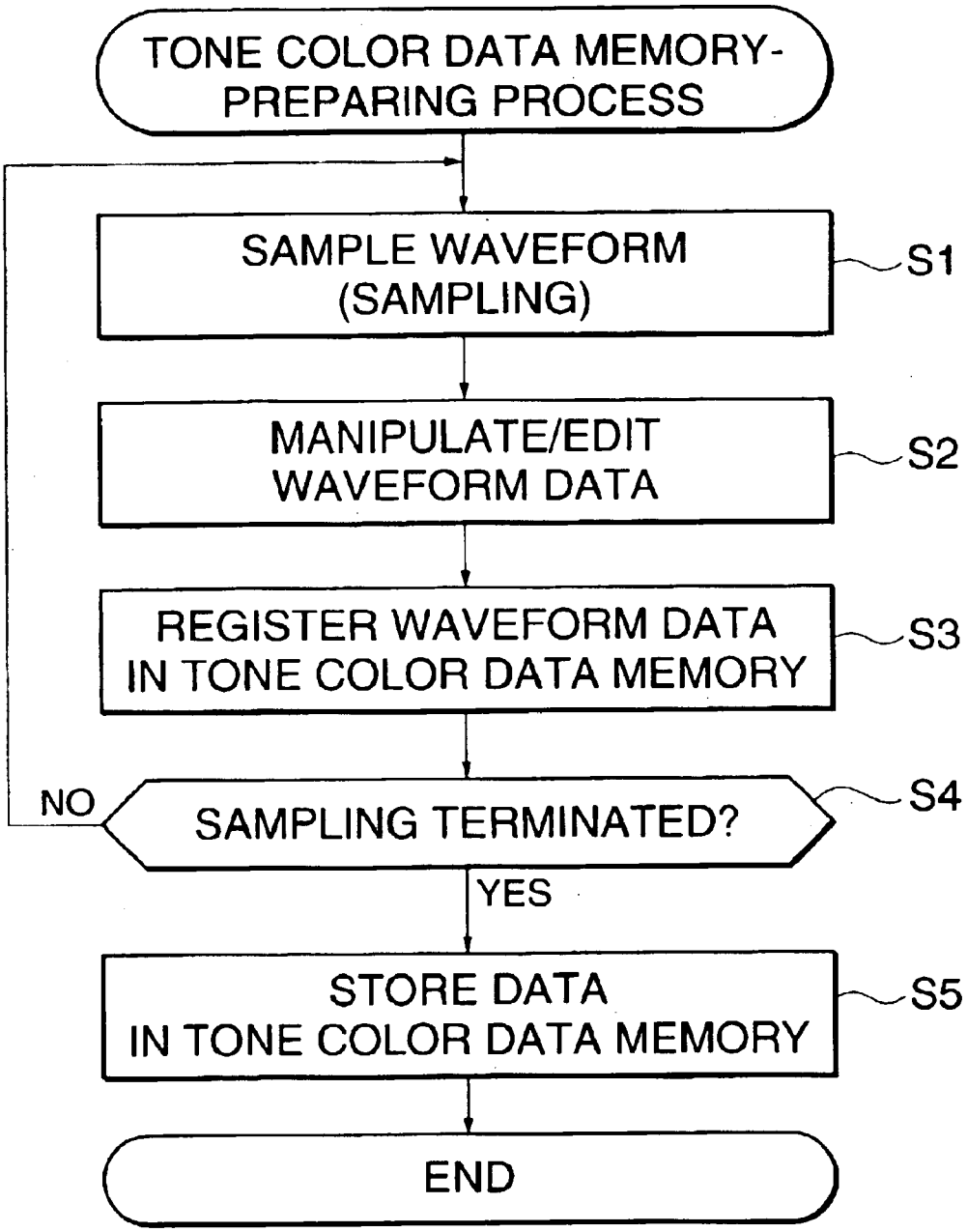
FIG. 2 is a flowchart showing a tone color data memory-preparing process.

FIG. 2 is a flowchart showing the tone color data memory-preparing process. This process is executed e.g. on a personal computer.

As shown in the figure, first, waveform samples of musical tones are taken, that is, sampling of the musical tones is carried out (step S1).

Figure 3:
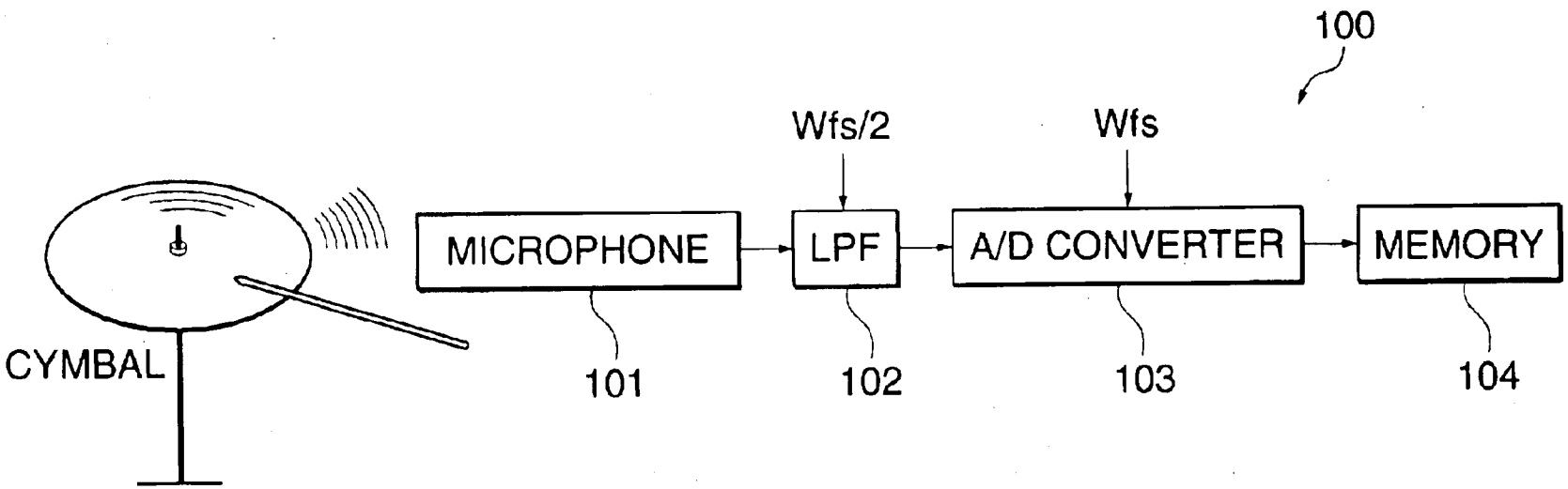
FIG. 3 is a diagram useful in explaining a step of sampling a musical tone waveform in FIG. 2.

FIG. 3 is a diagram useful in explaining operations carried out in the step S1 for sampling a musical tone waveform. FIG. 3 illustrates a method of taking waveform samples of a cymbal tone by using a personal computer 100.

As shown in the figure, first, a cymbal is struck with a stick to generate a cymbal tone, and then the cymbal tone is converted to an analog musical tone signal by a microphone 101.

Then, frequency components higher in frequency than half Wfs/2 of the recording sampling frequency Wfs are removed from the analog musical tone signal by an LPF (low-pass filter) 102 which passes only frequency components not higher in frequency than the frequency Wfs/2. The frequency components higher in frequency than the frequency Wfs/2 are thus removed because they are unnecessary for the waveform table tone generator 6 which is incapable of reproducing frequency components of musical tones higher in frequency than the frequency Wfs/2.

Then, the signal output from the LPF 102 is converted to a digital musical tone signal by an A/D converter 103 operating at the recording sampling frequency Wfs, and then the digital musical tone signal is stored in a memory (e.g. RAM) 104.

When the above process is continued over a predetermined time period, e.g. one second, a number of musical tone waveform samples corresponding to the frequency Wfs are stored in the memory 104. This set of musical tone waveform samples forms musical tone waveform data.

It should be noted that musical tone waveform data of a plurality of tone colors are registered in the tone color data memory, and to register musical tone waveform data of other musical instruments than the cymbal, it is only necessary to take waveform samples of musical tones thereof by the same method as described above.

Referring again to FIG. 2, the musical tone waveform data obtained by the sampling in the step S1 is processed/edited in a step S2. The processing/editing process includes e.g. elimination of zero-level (or low-level) waveform samples and adjustment of the amplitude of the musical tone waveform data.

Then, the musical tone waveform data processed/edited in the step S2 is registered in the tone color data memory in a step S3.

Figure 4:
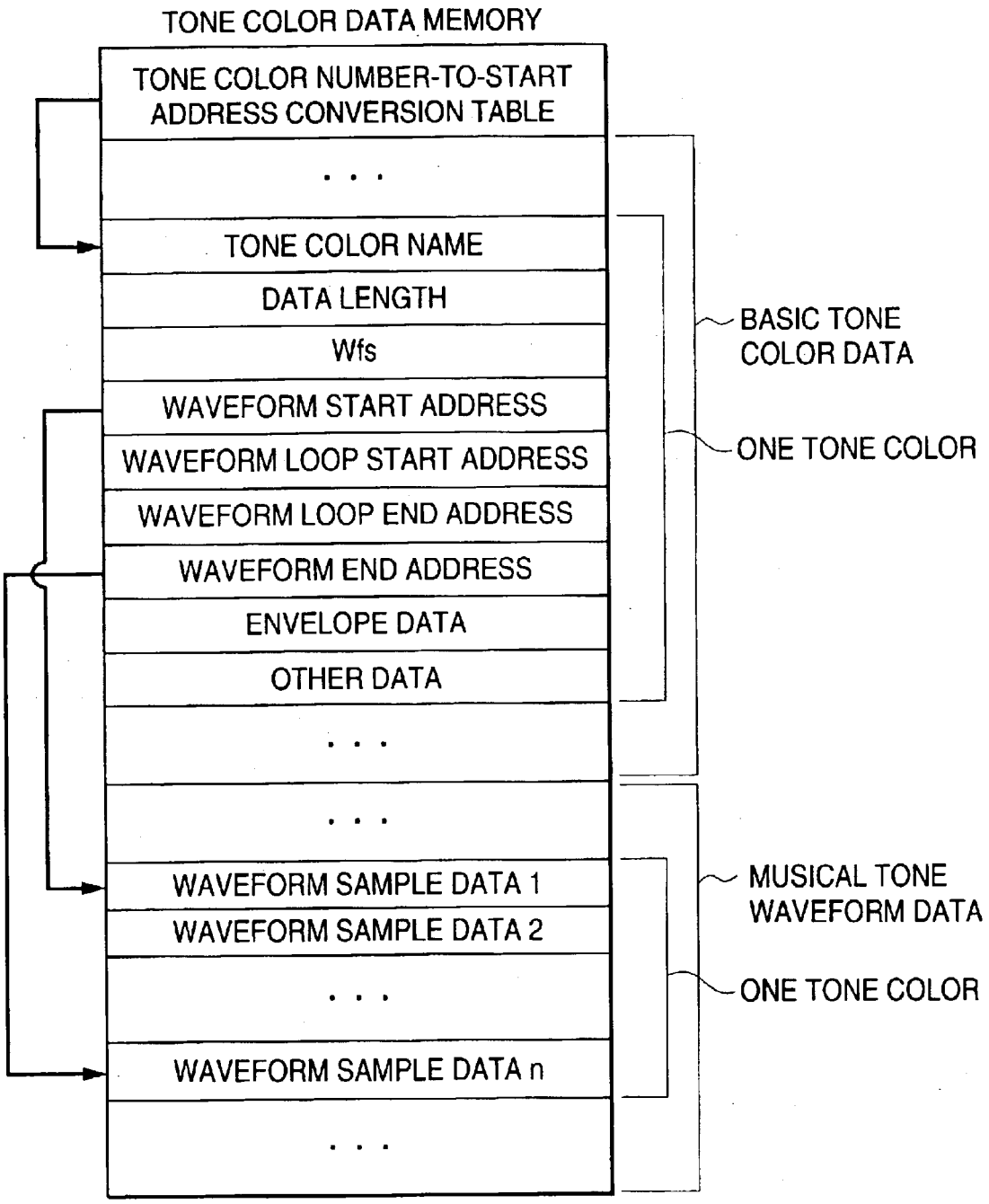
FIG. 4 is a diagram showing an example of a memory map of a tone color data memory.

FIG. 4 shows an example of a memory map of the tone color data memory. In the present embodiment, tone color data of one tone color is comprised of basic tone color data and musical tone waveform data. Since the tone color data memory allows entries of a plurality of tone color data, it stores, at a start address thereof, a conversion table for converting a tone color number (No) (e.g. a tone color number in the GM (General MIDI) system format) to the start address of an area in which basic color tone data corresponding to the tone color number is stored.

The basic color tone data of one tone color is comprised of the name of the tone color, the data length of the basic color tone data, the recording sampling frequency Wfs, a waveform start address indicative of a start address of the corresponding musical tone waveform data, a waveform loop start address indicative of the start address of an area in which a portion of the musical tone waveform data for loop reading is stored, a waveform loop end address indicative of the end address of this area for loop reading, a waveform end address indicative of the end address of the musical tone waveform data, envelope data for determining an envelope of the musical tone waveform data, and other data.

In the present embodiment, basic tone color data and corresponding musical tone waveform data are stored in respective different areas, and therefore the basic tone color data includes data indicative of the range of an area in which the corresponding musical tone waveform data is stored, i.e. the waveform start address and the waveform end address. However, assuming that musical tone waveform data is stored at a location immediately following corresponding basic tone color data, the start address of the musical tone waveform data can be calculated from the data length of the tone color data, which is included in the basic tone color data, and further the end address of the musical tone waveform data is an address immediately before the start address of basic tone color data of the following tone color data (this start address can be retrieved from the aforementioned conversion table for converting a tone color number (No) to a start address (hereinafter referred to as "the tone color number-to-start address conversion table"). Therefore, in this case, the waveform start address and the waveform end address may be omitted from the basic tone color data.

In the tone color data registration in the step S3, the musical tone waveform data stored in the memory 104 is registered in the tone color data memory such that the musical tone waveform data is adapted to the format of the FIG. 4 tone color data memory. More specifically, the musical tone waveform data is stored in a waveform data storage area, and at the same time corresponding basic tone color data is generated and stored in a basic tone color data storage area. Further, the start address of the basic tone color data is stored in a corresponding location in the tone color number-to-start address conversion table.

It should be noted that in this tone color data registration, a predetermined area having a capacity equal to that of the FIG. 4 tone color data memory is defined on a memory (which may be the memory 104 (in this case, however, the area needs to be different from the area in which the musical tone waveform data is stored) or a different storage medium) of the personal computer 100, and the musical tone waveform data stored in the memory 104 is registered in the predetermined area.

In the following step S4, it is determined whether or not there is a musical tone of another tone color of which waveform samples should be taken. If there is any, the process returns to the step S1 and is started again from the waveform sampling. On the other hand, if there isn't any, the program proceeds to a step S5.

In the step S5, tone color data having the same memory map as that of the tone color data registered in the predetermined area of the above memory is formed on the tone color data memory implemented e.g. by a ROM, that is, the tone color data registered in the predetermined area is embodied as the tone color data memory.

Next, a description will be given first of an outline and then of details of control processing executed by the cellular phone constructed as above with reference to FIGS. 5 and 6A to 6D.

In the cellular phone according to the present embodiment, to reduce the storage capacity of the tone color data memory, a musical tone waveform is sampled at the recording sampling frequency lower than the sampling frequency, and waveform data of musical tone waveform samples thus obtained is stored in the tone color data memory. When generating (reproducing) musical tones, corresponding musical tone waveform samples are read out from the tone color data memory, and various kinds of signal processing are carried out thereon to generate a musical tone signal. The present invention is characterized in that frequency components higher in frequency than half the recording sampling frequency, which were lost when the musical tone waveform was sampled, are recovered to approximate the original frequency components, based on the musical tone waveform samples taken for storage to thereby generate more natural musical tones.

More specifically, musical tone waveform samples read out are multiplied by digital data representative of a sine (sinusoidal) wave having half the recording sampling frequency Wfs (=Wfs/2) to thereby change the frequency spectrum of the musical tone waveform samples such that a spectral range of 0 to Wfs/2 is shifted to a spectral range of Wfs/2 to Wfs, then only frequency components of the samples in the spectral range Wfs/2 to Wfs after the shift are extracted and subjected to level adjustment, and the level adjusted frequency components are used as a substitute for the frequency components (spectrum) of Wfs/2 to Wfs lost by sampling. There is some correlation between the lost frequency spectrum of Wfs/2 to Wfs and the sampled or preserved frequency spectrum of 0 to Wfs/2, and hence, when a musical tone having frequency components (spectrum) of Wfs/2 to Wfs is generated based on the sampled or preserved components (spectrum) of 0 to Wfs/2, the spectrum of the generated frequency components of Wfs/2 to Wfs closely approximates the spectrum of the lost frequency components of Wfs/2 to Wfs.

Then, the waveform samples of frequency components of Wfs/2 to Wfs generated as above are added to the musical tone waveform samples read out, and then normal signal processing (e.g. impartment of an envelope) is carried out on the musical tone waveform samples obtained by the addition, to thereby generate a musical tone signal. This method makes it possible to generate more natural musical tones having approximately recovered frequency components (in the recovered frequency spectral range) of Wfs/2 to Wfs.

Next, the control processing outlined above will be described in detail. As mentioned above, the essential feature of the present invention consists in the musical tone signal-generating process, that is, the musical tone signal-generating process by using the waveform table tone generator 6. Therefore, the following description relates to the control process (musical tone signal-generating process) executed by the waveform table tone generator 6.

Figure 5:
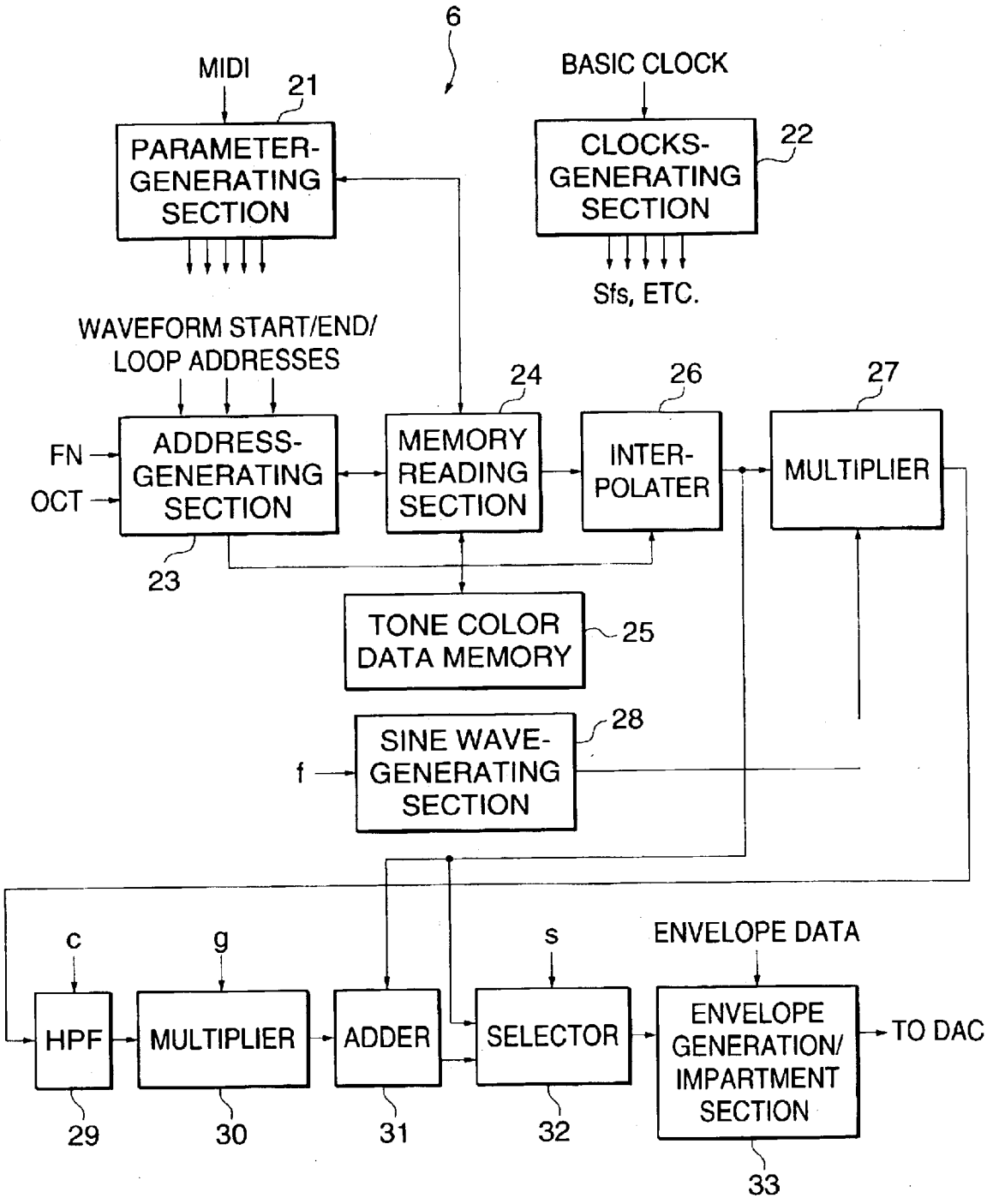
FIG. 5 is a block diagram showing a procedure of operations of a musical tone signal-generating process executed by a waveform table tone generator appearing in FIG. 1.

FIG. 5 is a block diagram showing the procedure of operations of the musical tone signal-generating process executed by the waveform table tone generator 6. It should be noted that the waveform table tone generator 6 is normally implemented by a DSP (digital signal processor), and hence most part of the control processing thereby is carried out by software. It goes without saying that the waveform table tone generator 6 may be entirely implemented by hardware.

As shown in FIG. 5, a parameter-generating section 21 receives MIDI data indicative of musical tones to be generated. Further, connected to the parameter-generating section 21 is a memory reading section 24 for reading out contents stored in the tone color data memory 25.

When MIDI data is input to the parameter-generating section 21, first, the parameter-generating section 21 analyzes the MIDI data and extracts information including a tone color number and a key code, i.e. information necessary for generation of parameters for musical tone generation. Then, the parameter-generating section 21 accesses the start address of the tone color data memory 25 via the memory reading section 24 and retrieves the start address of basic tone color data corresponding to the extracted tone color number from the tone color number-to-start address conversion table stored at the accessed address. Then, the parameter-generating section 21 reads out the basic tone color data of one tone color stored in an area starting from the retrieved start address, and generates the parameters for use in musical tone generation, based on the basic tone color data.

The parameters generated at this time are a waveform start address, a waveform end address, waveform loop addresses (a waveform loop start address and a waveform loop end address), envelope data, a sine wave frequency f, a cut-off frequency c, a multiplication coefficient g for amplitude adjustment, and a select value s. Out of the above-mentioned parameters, the waveform start address to the envelope data are included in the basic tone color data, while the sine wave frequency f to the select value s are generated based on the extracted tone color number and key code and the data included in the basic tone color data.

In the present embodiment, the sine wave frequency f is a frequency equal to half the recording sampling frequency, and hence it is calculated from the recording sampling frequency Wfs included in the basic tone color data. It should be noted that the sine wave frequency f need not be exactly equal to half the recording sampling frequency, but it may be a frequency close thereto.

The cut-off frequency c is also equal to half the recording sampling frequency, and hence it is calculated from the recording sampling frequency Wfs included in the basic tone color data.

The multiplication coefficient g for amplitude adjustment is calculated based on the recording sampling frequency and the extracted tone color number and key code, while the select value s is calculated based on the extracted tone color number and key code.

Although in the present embodiment, the parameters of the sine wave frequency f to the select value s are generated by calculation, they may be stored in advance as basic tone color data in the tone color data memory 25, as is the case with the parameters of the waveform start address to the envelope data, and read out therefrom.

Further, the parameter-generating section 21 generates an F number as a parameter indicative of an address advancement amount per one musical tone waveform sample and an OCT parameter indicative of an octave, based on the extracted tone color number and key code, the recording sampling frequency, and the sampling frequency.

A clocks-generating section 22 generates and outputs a plurality of types of clocks having respective frequencies e.g. by dividing the frequency of a basic clock supplied thereto. The most important one of these clocks is a clock having a sampling frequency Sfs which is the original sampling frequency of the waveform table tone generator 6. The operation of each of sections 23 to 33 of the waveform table tone generator 6 proceeds according to the clock of the sampling frequency Sfs.

It should be noted that in the present invention, the recording sampling frequency is lower than the sampling frequency, and therefore an address generated by an address-generating section 23 is usually represented as a real number value including a decimal fraction. More specifically, the address-generating section 23 usually generates addresses each indicative of a location between musical tone waveform samples stored in the tone color data memory 25. Therefore, as described in detail hereinafter, a musical tone waveform sample at such a location is obtained by interpolation of musical tone waveform samples stored in the tone color data memory 25.

The integer portion of each address formed by a real number value, generated by the address-generating section 23 is supplied to the memory reading section 24, while the decimal portion thereof is supplied to an interpolater 26.

The memory reading section 24 reads out a musical tone waveform sample corresponding to the supplied integer portion of the address and a predetermined number of musical tone waveform samples adjacent thereto from the tone color data memory 25, and outputs the musical tone waveform samples to the interpolater 26. The predetermined number is determined according to a predetermined method of interpolation used by the interpolater 26. For instance, when the interpolation method is a linear interpolation between two points, the predetermined number is set to one. In this case, the memory reading section 24 reads out the musical tone waveform sample corresponding to the supplied integer portion of the address and a musical tone waveform sample located at the next address and outputs these to the interpolater 26.

By the predetermined interpolation method, the interpolater 26 performs interpolation of the musical tone waveform samples read out from the tone color data memory 25, based on the decimal portion of the supplied address, to thereby generate a desired musical tone waveform sample.

The musical tone waveform sample output from the interpolater 26 is supplied to a multiplier 27. In addition to the musical tone waveform sample, the multiplier 27 is supplied with digital data representative of a sine wave having the frequency f (=Wfs/2), or more specifically, one of waveform samples of a sine wave having the frequency f, which corresponds to the musical tone waveform sample, from a sine wave-generating section 28. The multiplier 27 multiplies the musical tone waveform sample from the interpolater 26 by the waveform sample of the sine wave corresponding to the musical tone waveform sample, and outputs the resulting product of the multiplication to an HPF (high-pass filter) 29.

The HPF 29 is also supplied with information of the cut-off frequency c (=Wfs/2) and eliminates or cuts frequency components of 0 to Wfs/2 contained in the musical tone waveform samples from the multiplier 27 to deliver the resulting musical tone waveform samples to a multiplier 30.

The multiplier 30 is also supplied with the multiplication coefficient g for amplitude adjustment, and multiplies the musical tone waveform sample from the HPF 29 by the multiplication coefficient g to deliver the resulting product to an adder 31. This adjusts the amplitude of the musical tone waveform sample to a desired amplitude.

The adder 31 is also supplied with the musical tone waveform sample from the interpolater 26 and adds together the musical tone waveform samples from the interpolater 26 and the multiplier 30 to deliver the resulting sum to one input terminal of a selector 32.

The selector 32 also receives the musical tone waveform sample from the interpolater 26 at the other input terminal thereof. Further, the selector 32 receives the aforementioned select value s at a select terminal thereof. Responsive to the select value s, the selector 32 selects and delivers one of musical tone waveform samples input via the input terminals to an envelope generation/impartment section 33. More specifically, the selector 32 selects one of the musical tone waveform sample containing high-frequency components approximately recovered or in a pseudo manner, and the musical tone waveform sample from the interpolater 26, according to the select value s, and delivers the selected one of the waveform samples to the envelope generation/impartment section 33. Thus, the selector 32 functions as a means for selecting whether to add the pseudo high-frequency components to the musical tone to be generated.

The envelope generation/impartment section 33 is also supplied with envelope data, and generates an envelope based on the envelope data to add the same to the musical tone waveform sample from the selector 32, followed by delivering the resulting musical tone waveform sample to the DAC.

Figure 6A:
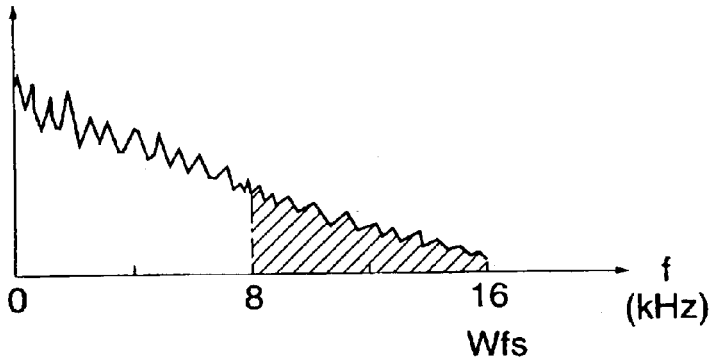
Figure 6B:
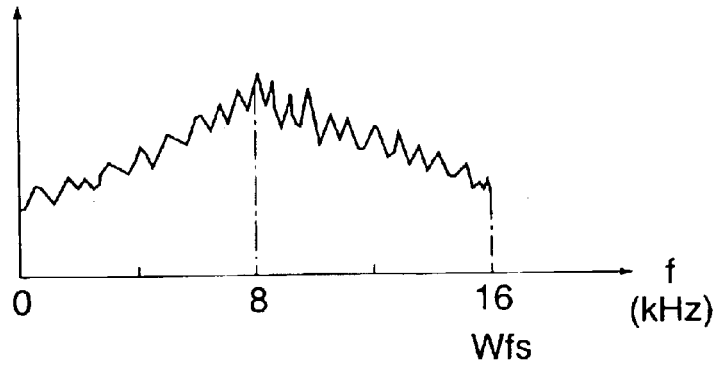
Figure 6C:
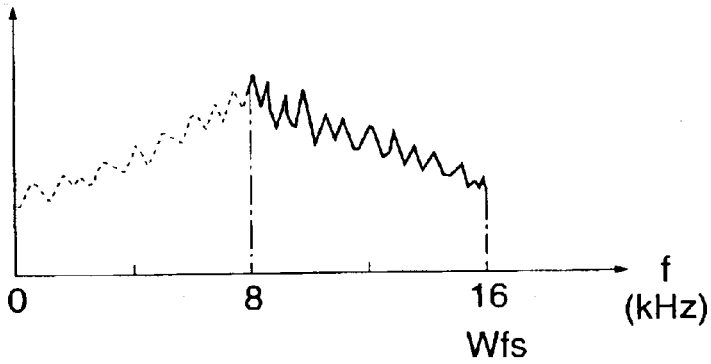
Figure 6D:
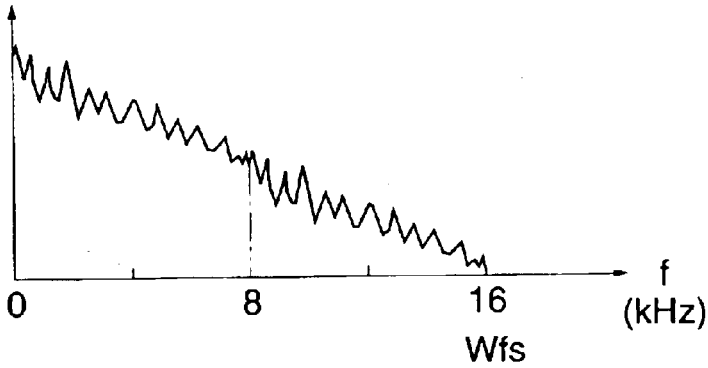

FIGS. 6A to 6D show results of signal processing executed by predetermined sections of the waveform table tone generator 6. FIG. 6A shows the frequency spectrum of musical waveform data generated by sampling a musical tone at a recording sampling frequency of 16 KHz. FIG. 6B shows a frequency spectrum obtained by multiplying the FIG. 6A musical waveform data by digital data of a sine wave of 8 KHz by the multiplier 27. FIG. 6C shows a frequency spectrum obtained by eliminating or cutting off frequency components (spectrum) in a frequency range lower than 8 KHz from the FIG. 6B frequency spectrum by the HPF 29. Further, FIG. 6D shows a result of addition by the adder 31, i.e. the frequency spectrum of a desired musical tone signal. It is assumed that the sampling frequency here is 32 KHz, and therefore, when a musical tone is sampled at this sampling frequency, it is possible to generate a musical tone corresponding to frequency components in a frequency range of 0 to 16 KHz.

The hatched area in FIG. 6A shows frequency components (frequency spectrum) lost when sampling is performed at the recording sampling frequency of 16 KHz. For recovery of the lost frequency components, first, as shown in FIG. 6B, the original musical tone waveform data is multiplied by the digital data representative of the sine wave of 8 KHz so that the whole frequency spectrum of the original musical tone waveform data is shifted in a positive or increasing direction by 8 KHz. According to the signal theory, multiplication of two signals in a time domain results in addition/subtraction of frequency components in a frequency domain, and further, the sine wave as one of the two signals is represented in frequency spectrum by a single spectrum line at the frequency of the sine wave, i.e. at 8 KHz in the illustrated example, so that the resulting product or musical tone waveform data is comprised of components totally shifted in frequency by 8 KHz in the positive or increasing direction and components symmetrical in frequency spectrum to these components with respect to 8 KHz.

Then, as shown in FIG. 6C, unnecessary frequency components (spectrum), specifically, frequency components (spectrum) below 8 KHz are removed from the resulting musical tone waveform data whose frequency spectrum is shown in FIG. 6B. This processing is performed by the HPF 29 as described above. Then, the amplitude (level) of the FIG. 6C frequency spectrum is adjusted, and the original musical tone waveform data is added to the musical tone waveform data adjusted in amplitude. As a result, as shown in FIG. 6D, the frequency spectrum of the original musical tone waveform data and the FIG. 6C frequency spectrum are properly coupled to each other, whereby the frequency components lost as shown in the FIG. 6A spectrum are approximately recovered.

In general, if a natural sound is arranged with frequency components thereof distributed along the axis of frequency, frequency components (spectrum) below approximately 8 KHz contain information for recognizing the sound itself, i.e. information for identifying the kind of the sound, such as piano tone, violin tone, or human voice. On the other hand, frequency components (spectrum) of approximately 8 KHz to 16 KHz (the upper limit of an audible frequency range) generally contains information for creating naturalness of the sound. Even if the spectrum in this frequency range is entirely lost, it is possible to recognize the sound, but the naturalness of the sound is largely lost. In the present embodiment, the information for creating naturalness of a sound, i.e. frequency components (spectrum) in the range of 8 KHz to 16 KHz are approximately recovered as described above, so that it is possible to generate more natural musical tones.

Although in the present embodiment, the processing of shifting the frequency spectrum is performed by multiplying the original musical tone waveform data by digital data representative of a sine wave of a predetermined frequency, so long as the whole frequency spectrum of the original musical tone waveform data can be shifted by a predetermined frequency, any suitable processing method other than the above method may be employed.

Further, in the present embodiment, the musical tone generating apparatus of the invention is applied to a cellular phone, particularly to the tone generator thereof. This is because in a normal tone generator provided in an electronic keyboard musical instrument or the like, it is not necessary to reduce the storage capacity of a tone color data memory (waveform memory) provided therein to such an extent that the quality of reproduced musical tones is degraded by sampling musical tones at a recording sampling frequency lower than the sampling frequency. Therefore, conversely, the musical tone generating apparatus of the present invention can also be applied to any other apparatus or system than a cellular phone, so long as it necessitates sampling of musical tones at a recording sampling frequency lower than the sampling frequency.

Further, in the above described embodiment, the lost frequency components are recovered by using the whole of the sampled or preserved frequency components. However, in the case of reproducing a musical tone with high-level frequency components (spectrum) concentrated in a low-frequency range, such as a tone of a percussion instrument, if the whole preserved frequency components are used for recovery of the lost frequency components, high-level frequency components (spectrum) thereof are concentrated in a lower frequency range of the recovered frequency components. As a result, the musical tone is reproduced as an unnatural sound having a different frequency spectrum from that of the original tone.

FIGS. 7A to 7D show results of signal processing carried out by using a part (2 KHz to 8 KHz) of sampled or preserved frequency components, for recovery of lost frequency components. Frequency spectra in the figures correspond to the respective frequency spectra in FIGS. 6A to 6D.

Figure 7A:
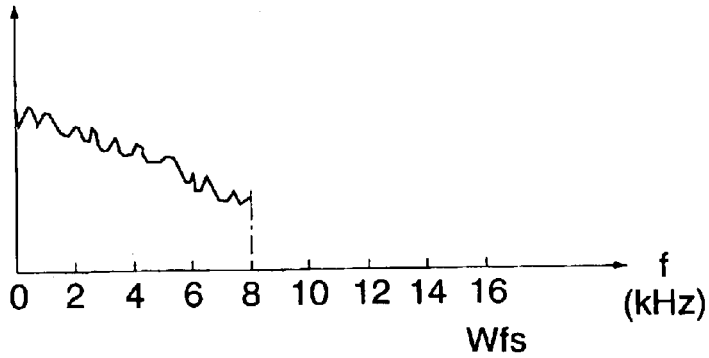
FIGS. 7A to 7D are diagrams showing results of signal processing carried out by using a portion (2 KHz to 8 KHz) of sampled or preserved frequency components, for recovery of lost frequency components, which correspond to the FIGS. 6A to 6D frequency spectra, respectively.
Figure 7B:
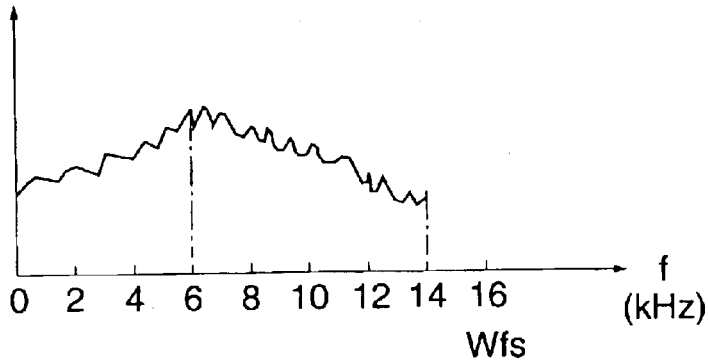
Figure 7C:
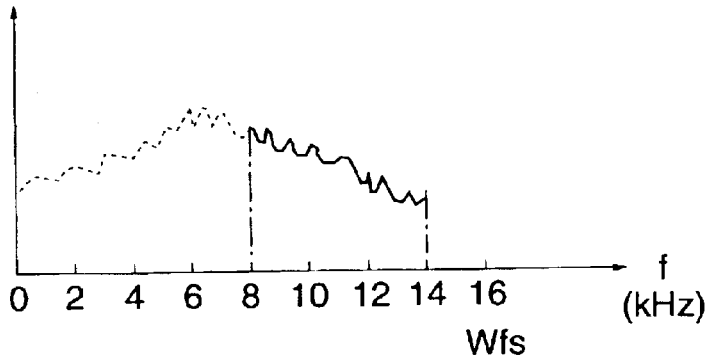
Figure 7D:
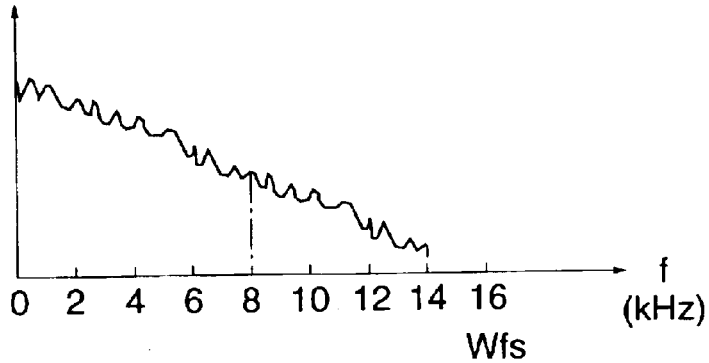

As shown in FIG. 7A, when sampling is performed at a recording sampling frequency of 16 KHz, frequency components above 8 KHz are lost. For recovery of the lost frequency components, first, as shown in FIG. 7B, musical tone waveform data shown in FIG. 7A is multiplied by digital data representative of a sine wave of 6 KHz to thereby shift the whole frequency spectrum of the original musical tone waveform data in the positive or increasing direction by 6 KHz. Then, as shown in FIG. 7C, unnecessary frequency components (spectrum) below 8 KHz are removed from the FIG. 7B frequency spectrum. Further, the amplitude (level) of the FIG. 7C frequency components (spectrum) is adjusted. Thereafter the original musical tone waveform data is added to the FIG. 7C frequency components (spectrum). As a result, as shown in FIG. 7D, the frequency spectrum of the original musical tone waveform data and the FIG. 7C frequency spectrum are properly coupled to each other. Thus, the frequency components (spectrum) lost as shown in the FIG. 7A are recovered.

The above signal processing explained with reference to FIGS. 7A to 7D can be carried out without changing the procedure of operations described hereinabove with reference to FIG. 5, except that the sine wave frequency f supplied to the sine waveform-generating section 28 is changed to 6 KHz.

As described above, in the present embodiment, sampling of musical tones is carried out at the recording sampling frequency lower than the sampling frequency, and the frequency components lost in preparation of the musical tone waveform data, i.e. frequency components higher in frequency than half the recording sampling frequency, are approximately recovered based on the sampled or preserved frequency components, so that it is possible to generate a more natural musical tone from the sampled musical tone waveform data.

According to the present invention, in the case of musical tone waveform data whose frequency spectrum is linear, specifically, musical tone waveform data having a spectrum in the form of discrete spectrum lines appearing therein, frequency components (spectrum) approximately recovered based on the musical tone waveform data often do not approximate lost frequency components (spectrum), and hence it is impossible to generate a natural musical sound. Therefore, according to the present invention, it is preferred to use musical tone waveform data whose frequency spectrum is non-linear, e.g. musical tone waveform data of a rhythm-type tone color, a noise-type tone color, or the like. Further, the apparatus may be configured such that the selector 32 carries out selection, depending on the shape of the frequency spectrum of a musical tone, as to whether frequency components recovered in a pseudo manner should be added to original musical tone waveform samples during musical tone generation.

Further, it also goes without saying that the object of the present invention may be accomplished by supplying a storage medium in which is stored software program code realizing the functions of the above-described embodiment to a system or apparatus, and causing a computer (CPU or MPU) of the system or apparatus to read out and execute the program code stored in the storage medium.

In this case, the code of the program itself read out from the storage medium achieves the novel functions of the above-described embodiment, and the storage medium storing the program constitutes the present invention.

The storage medium for supplying the program to the system or apparatus may be a flexible disk, a hard disk, an optical disk, a magneto-optical disk, a CD-ROM, a CD-R, a CD-RW, DVD-ROM, a DVD-RAM, a DVD–RW, a DVD+RW, a magnetic tape, a nonvolatile memory card, or a ROM, for instance.

Moreover, it also goes without saying that the functions of the above-described embodiment may be realized not necessarily by causing the computer to read and execute the program code, but alternatively by causing an operating (OS) system running on the computer to perform part or all of the actual processing based on instructions in the program code.

What is claimed is:

1. A musical tone generating apparatus comprising:

a waveform memory that stores musical tone waveform data obtained by sampling a tone of a musical instrument at a recording sampling frequency lower than an original sampling frequency of the musical tone generating apparatus; and a musical tone generator that generates a musical tone based on the musical tone waveform data read out;

wherein said musical tone generator comprises:

a shifter that shifts all frequency components included in the musical tone waveform data read out in a positive direction by a predetermined frequency lower than half the recording sampling frequency;

an amplitude adjuster that adjusts amplitude of musical tone waveform data formed by said shifter by shifting the frequency components; and an adder that adds together the musical tone waveform data adjusted in amplitude and the musical tone waveform data read out.

2. A musical tone generating apparatus according to claim 1, wherein said shifter comprises a generator that generates a sinusoidal wave signal of a predetermined frequency lower than the half the recording sampling frequency, a multiplier at multiplies the musical tone waveform data read out by the generated sinusoidal wave signal, and a cutter that cuts off frequency components of the resulting product of the multiplication lower in frequency than the half the recording sampling frequency.

3. A musical tone generating apparatus according to claim 1, wherein the tone of the musical instrument for sampling has a non-linear frequency spectrum.

4. A musical tone generating apparatus according to claim 1, wherein the predetermined frequency is determined depending on the musical instrument of which the tone is sampled.

5. A musical tone generating apparatus according to claim 1, further comprising a selector that selects between generation of a musical tone based on musical tone waveform data formed by adding together the musical tone waveform data adjusted in amplitude and the musical tone waveform data read out, and generation of a musical tone based on the musical tone waveform data read out to which the musical tone waveform data adjusted in amplitude is not added.

6. A musical tone generating apparatus according to claim 5, wherein said selector is operable when the musical tone has a non-linear frequency spectrum, to select the generation of a musical tone based on the musical tone waveform data formed by adding together the musical tone waveform data adjusted in amplitude and the musical tone waveform data read out.

7. A musical tone generating method comprising:

a reading step of reading out musical tone waveform data from a waveform memory storing the musical tone waveform data obtained by sampling a tone of a musical instrument at a recording sampling frequency lower than a sampling frequency at which a musical tone is generated; and a musical tone generating step of generating the musical tone based on the musical tone waveform data read out, wherein said musical tone generating step comprises the steps of:

shifting all frequency components included in the musical tone waveform data read out, in a positive direction by a predetermined frequency lower than half the recording sampling frequency;

adjusting amplitude of musical tone waveform data formed by shifting the frequency components;

adding together the musical tone waveform data adjusted in amplitude and the musical tone waveform data read out; and generating the musical tone based on a result of the addition.

8. A program for causing a computer to execute a musical tone generating method comprising the steps of:

a reading step of reading out musical tone waveform data from a waveform memory storing the musical tone waveform data obtained by sampling a tone of a musical instrument at a recording sampling frequency lower than a sampling frequency at which a musical tone is generated; and a musical tone generating step of generating the musical tone based on the musical tone waveform data read out, wherein said musical tone generating step comprises the steps of:

shifting all frequency components included in the musical tone waveform data read out, in a positive direction by a predetermined frequency lower than half the recording sampling frequency;

adjusting amplitude of musical tone waveform data formed by shifting the frequency components;

adding together the musical tone waveform data adjusted in amplitude and the musical tone waveform data read out; and generating the musical tone based on a result of the addition.

* * * * *